252-99 AU 163 EX
11/9/76 OR 3,991,000

United States Patent [19]
Chazard et al.

[11] 3,991,000
[45] Nov. 9, 1976

[54] BUILT BLEACHING DETERGENT

[75] Inventors: Georges Jean Paul Chazard, Bezons; Yvon Demangeon, Saint-Cloud, both of France

[73] Assignee: Colgate-Palmolive Company, New York, N.Y.

[22] Filed: Nov. 1, 1974

[21] Appl. No.: 519,898

[30] Foreign Application Priority Data

Dec. 11, 1973 France ..... 73.44215

[52] U.S. Cl. ..... 252/99; 252/102; 252/DIG. 11

[51] Int. Cl.[2] ..... C11D 7/56; C11D 7/38

[58] Field of Search ..... 252/99, 102, DIG. 11

[56] References Cited

UNITED STATES PATENTS

| | | | |
|---|---|---|---|
| 3,211,658 | 10/1965 | Hirtz et al. | 252/99 |
| 3,725,289 | 4/1973 | Mouret | 252/99 X |
| 3,746,646 | 7/1973 | Boixader | 252/99 X |
| 3,751,222 | 8/1973 | Gobert | 252/99 X |
| 3,795,625 | 3/1974 | Kowalski | 252/99 X |
| 3,846,346 | 11/1974 | Conn | 252/99 |

*Primary Examiner*—Mayer Weinblatt
*Attorney, Agent, or Firm*—Robert L. Stone; Murray M. Grill; Herbert S. Sylvester

[57] ABSTRACT

A bleaching detergent composition, in which the bleaching component is a water soluble inorganic percompound, such as sodium perborate, includes an alkali metal builder salt, such as pentasodium tripolyphosphate, a water soluble organic builder salt, such as trisodium nitrilotriacetate and an organic detergent, such as sodium linear higher alkyl benzene sulfonate, and is improved in bleaching effectiveness by inclusion therein of a particular concentration of a water soluble copper salt, such as copper sulfate hydrate, which results in the presence of a particular desirable proportion of copper ions in the bleaching detergent solution resulting from normal use of the composition.

9 Claims, No Drawings

BUILT BLEACHING DETERGENT

This invention relates to a novel detergent composition. More particularly, the present invention relates to a built detergent composition characterized by enhanced bleaching efficiency.

Built detergent compositions designed for laundering the wide range of fabrics available in the commercial market are termed "heavy duty" detergents. These detergents typically comprise a surface active agent of the anionic, nonionic or amphoteric type or mixtures thereof with a polyphosphate, the latter being designed to augment the cleansing efficiency of the surface active agent. The polyphosphate most commonly utilized in such applications is sodium tripolyphosphate (STP), which is hydrolytically unstable and subject to degradation in aqueous solution. Recent studies have indicated that the presence of polyphosphates may alter the ecological balance of waters in lakes, rivers and streams. In response to these limitations, workers in the art have focused their interest upon reduction of the polyphosphates in built detergents. This end has been sought by partial or total substitution of non-phosphate builders for the polyphosphates.

Although a wide variety of non-phosphate builders was considered for such purposes, generally cleaning effect was reduced. It was determined that unexpectedly desirable efficiency could be obtained with a detergent containing conventional polyphosphate builder salts with water soluble salts of nitrilotriacetic acid (NTA) of the general formula

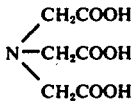

wherein a cation, typically sodium, is substituted for the acid hydrogen atoms. Mixtures of the foregoing type, containing STP and NTA, were found to evidence outstanding building properties with a wide range of active detergent substances and to be compatible with many of the adjuvants commonly used in detergent compositions. However, auxiliary problems were soon recognized, particularly in detergents containing persalt bleaching agents.

It is, of course, well known that detergent powders often contain per-compound salts which effect oxidation of dye-like stains fixed on textile fibers. The bleaching agents selected for this purpose, typically water soluble perborates, are unstable and decompose during the washing process, so yielding gaseous oxygen. The tendency to decompose is aggravated by the presence of heavy metals contained either as impurities in water or in washing containers, such impurities catalyzing the decomposition of the bleaching agent.

A procedure for alleviating this limitation was described in French Pat. No. 1,338,856, granted Aug. 26, 1963 and in corresponding U.S. Pat. No. 3,211,658, issued on Oct. 12, 1965. The technique described therein involves adding a certain sequestering agent together with a water soluble inorganic copper salt in an amount ranging from 30 to 300 ppm copper to the detergent, the sequestering agent forming a complex with the copper salt which precludes a diminution in bleaching power. Sequestering agents found suitable for this purpose are NTA, methylaminodiacetic acid and hydroxyethylaminodiacetic acid or salts thereof.

With the foregoing considerations in mind, it appeared to follow from a logical standpoint that an ideal detergent could be compounded by admixing the polyphosphate-nitrilotriacetic acid builder with a perborate and small quantities of a copper salt. It was theorized that such mixture would diminish the catalytic decomposition of the perborate while essentially maintaining the bleaching power thereof. Much to the distress of the detergent researchers, it was found that the bleaching efficiency of built perborate detergents was reduced by as much as forty percent by the total or partial replacement of tripolyphosphates with salts of nitriloacetic acid. This reduction in perborate efficiency has been attributed to overstabilization of the perborate or the sequestration by the nitrilotriacetic acid salt of the heavy metal traces present in detergent solutions which catalyze perborate composition.

In accordance with the present invention, a technique for alleviating this prior art limitation has been described. This end is attained by compensating for the sequestrant effect of nitrilotriacetic acid by adding a transition metal salt, preferably a copper salt such as copper sulfate pentahydrate, to the built detergent in an amount sufficient to overcome the overstabilization of perborate resulting from chelation of heavy metals normally present in the washing bath. Thus, the inventive concept resides in the discovery that the addition of large amounts of a transition metal salt, far in excess of the amount previously proposed, enhances the bleaching power and overall detergency characteristics of NTA-TPP-perborate containing detergents.

Compositions made in accordance with this invention consist essentially (a) 4 to 40% of a water soluble synthetic organic detergent selected from the group consisting of anionic, nonionic and amphoteric detergents; (b) 5 to 50% of a water soluble inorganic percompound selected from the group consisting of perborates, percarbonates and perphosphates; (c) 15 to 30% of alkali metal builder salt selected from the group consisting of alkali metal tripolyphosphates, alkali metal pyrophosphates, alkali metal orthophosphates and alkali metal citrates; (d) 10 to 19% of a water soluble salt of an acid selected from the group consisting of nitrilotriacetic acid, hydroxyethyl aminodiacetic acid, iminodiacetic acid and N,N-bis(carboxymethyl-)amino-2-pentanedioic acid; and (e) such percentage of a water soluble inorganic copper salt as to contain, on a detergent composition basis, 0.125 to 0.25% of copper, with all percentages given being by weight.

The builder-perborate composition of the present invention may be employed in conjunction with any of the well known anionic, nonionic or amphoteric type synthetic surface active agents or mixtures thereof.

Anionic synthetic surface active agents are described as those compounds which contain hydrophilic and lyophilic groups and which ionize in an aqueous medium to yield anions of the larger group. The alkyl aryl sulfonates, the alkane sulfates and sulfated oxyethylated alkyl phenols are typical anionic surface active compounds.

The alkyl aryl sulfonates may be represented by the general formula $$(R)_x \cdot (R')Z \cdot (SO_3M)_y$$

wherein R is hydrogen or a straight or branched chain hydrocarbon having from 1–4 carbon atoms, R′ is a straight or branched chain hydrocarbon radical having from 1–24 carbon atoms, $x$ is an integer from 1–3, $y$ is an integer from 1–2, Z is a phenyl or naphthyl radical, and M is either hydrogen, an alkali metal, such as sodium and the like, or an organic amine such as ethanolamine, etc.

Compounds falling within the scope of the foregoing formula which are particularly well suited for use herein are alkyl aryl sulfonates such as sodium dodecylbenzene sulfonate, sodium decylbenzene sulfonate, ammonium methyl dodecylbenzene sulfonate, ammonium dodecylbenzene sulfonate, sodium octadecylbenzene sulfonate, sodium nonylbenzene sulfonate, sodium dodecylnaphthalene sulfonate, etc.

The alkyl sulfates are conveniently represented by the general formula $$R''OSO_3M$$

wherein M is represented as above and R″ is a straight or branched chain saturated hydrocarbon radical having from 8-18 carbon atoms or a mixed alkyl radial derived from fatty oils such as coconut oil, talow, cottonseed oil, etc.

Typical alkyl sulfates suitable in this use are sodium octadecyl sulfate, sodium hexadecyl sulfate, sodium dodecyl sulfate, potassium tetradecyl sulfate and the like.

The sulfated oxyethylated alkylphenols may be selected from among ammonium nonylphenoxy tetraethylenoxy sulfate, sodium dodecylphenoxy triethyleneoxy sulfate, ethanolamine decylphenoxy tetraethyleneoxy sulfate, etc. Olefin and paraffin sulfonates, typically containing 8–22 carbon atoms may also be employed.

Nonionic surface active compounds can be described as compounds which do not ionize but acquire hydrophilic characteristics from an oxygenated side chain such as polyoxyethylene and the lyophilic moiety from fatty acids, phenol, alcohols, amides or amines. Illustrative of these synthetic nonionic surface active agents are the products obtained from condensing ethylene or propylene oxides with propylene glycol, ethylene diamine, diethylene glycol, dodecyl phenol, nonyl phenol and the like.

Amphoteric surface active agents are compounds which include both anionic and cationic groups. Illustrative of the amphoteric compounds are the amido alkane sulfonates represented by the general formula $$R-CO-\underset{\underset{R'}{|}}{N}-(CH_2)_nSO_3M$$

wherein M is hydrogen or an alkali metal such as sodium, potassium, or ammonium, $n$ is an integer from 1–5, R is an alkyl radical having from 8–18 carbon atoms and R′ is selected from the group consisting of hydrogen, alkyl, aryl or alicyclic radicals. Exemplary of compounds within the scope of this formula are the C-aliphatic substituted, N-aliphatic substituted, amido alkyl sulfonates, the C-aliphatic substituted, N-aryl substituted, amido alkyl sulfonates, the C-aliphatic substituted, N-cycloalkyl substituted, amido alkyl sulfonates and the like.

The concentration of detergent utilized in the practice of the present invention may range from 4 to 40 percent by weight. Substantial amounts of builder materials may also be present, typically ranging up to 40 percent, by weight, preferably from 20 to 40 percent, of the detergent composition. Builders found suitable for this purpose are water soluble salts such as sodium sulfate, sodium citrate, sodium tripolyphosphates, sodium pyra- and orthophosphates and the like. It will, of course, be appreciated by those skilled in the art that the main impact of the instant invention resides in a polyphosphate detergent and such is to be considered a preferred embodiment.

The oxidizing bleaching agent preferably employed in the compositions of the invention is sodium perborate, either tetrahydrate or monohydrate. However, other perborates and other persalts such as percarbonate and perphosphate salts may also be chosen for this purpose. The bleaching agent is employed in an amount ranging from 5–50 percent by weight of the detergent composition, the minima and maxima being dictated by practical considerations.

As indicated previously, the sequestering agent selected for use in the practice of the present invention is a water soluble salt of nitrilotriacetic acid (NTA) of the general formula:

$$N\begin{cases} CH_2COOH \\ CH_2COOH \\ CH_2COOH \end{cases}$$

The cation most frequently selected for substitution for the acid hydrogens therein is an inorganic cation such as ammonium or sodium. The cation may be organic such as a quaternary ammonium cation. Sodium is preferred. The cations permit the NTA salt to be soluble in water. Studies have revealed that the synergistic and unexpected results attained herein require from 5–30 weight percent of the NTA salt based upon the weight of the detergent, a preferred range being from 5–15 weight percent.

In the practice of this invention, it has been found that in addition to the water soluble salt of NTA, described above, desirable cleaning efficiency could be obtained using a water soluble salt of hydroxyethyl aminodiacetic acid, of imino diacetic acid or of N,N-bis-(carboxymethyl)-amino-2-pentane dioic acid.

It will be understood by those skilled in the art that the pH of the described detergent containing the persalt bleaching agent is generally in the range of from 10 to 10.5. During the washing cycle, the pH typically falls to a value within the range of 9 to 9.5, such decline being attributed to soil hydrolysis. However, this decline can also be precluded or effectively retarded by introducing soda ash or silicates such as sodium silicate to the detergent.

The water soluble copper salt selected for use in the practice of the present invention is preferably the pentahydrate of copper sulfate. The amount of this copper salt in the detergent ranges from 0.1 to 1 percent by weight which approximately corresponds with a $Cu^{++}$ concentration ranging from 3–10 ppm (parts per million) in solution. This is in marked contrast to the prior art work alluded to hereinabove in which the copper concentration ranged from 0.003 to 0.03 percent by weight of the detergent.

In addition to the foregoing constituents, the composition of the invention desirably includes hydrazine or hydroxylamine salts such as hydroxylamine sulfate (HS) in an amount ranging from 0.5–2 percent by weight based on the weight of the detergent composition. This compound is added for the purpose of eliminating the effect of natural soil enzymes (catalases) which interfere with the bleaching mechanism by decomposing the perborate.

Other additives present in the detergent may include antiredeposition agents, brightening agents, perfumes and the like. These additives are generally used in amounts ranging up to about 10 percent, by weight of the detergent composition. Compositions such as sodium carboxymethyl cellulose and methyl cellulose are generally classified as antiredeposition agents and are normally used in amounts less than 2 percent by weight of the detergent composition. Corrosion inhibitors such as sodium silicate in amounts ranging from 1–7 percent by weight may also be employed.

The following formulation is representative of the generic detergent composition described herein:

TABLE I

| | | |
|---|---|---|
| (a) | Water soluble organic detergent | 4–40% |
| (b) | Water soluble inorganic perborate | 5–30% |
| (c) | Water soluble alkali builder salt | 0–40% |
| (d) | Salt of nitrilotriacetic acid | 5–30% |
| (e) | Water soluble inorganic copper salt | 0.1–1% |
| (f) | Hydroxylamine sulfate | 0.5–20% |
| (g) | Water, brightening agents, perfume, coloring matter, balance to | 100% |

The following examples are given further to illustrate the invention. They are not to be regarded as limiting, the claims being the sole limitation. All amounts and percentages in the specification and in the examples are by weight unless otherwise indicated.

EXAMPLE 1

A basic detergent composition having the following formulation was prepared:

| Constituent | Percent by Weight |
|---|---|
| Sodium dodecylbenzene sulfonate | 3 |
| Sodium tallow soap | 6 |
| Tallow alcohol EO 25:1 | 5 |
| Sodium carboxymethyl cellulose | 1 |
| Optical brighteners | 0.3 |
| Alkaline protease | 0.5 |
| Dyes, perfume | 0.5 |
| Hydroxylamine salt | 1 |
| Sodium silicate | 5 |
| Pentasodium tripolyphosphate (SPP) | As indicated |
| Sodium perborate | 20 |
| Sodium nitrilotriacetate (NTA) | As indicated |
| Copper sulfate pentahydrate | As indicated (in ppm) |
| Water, sodium sulfate, balance to | 100 |

The concentrations of ingredients in solution are calculated from the percentages in the detergent and the concentration of the detergent in the washing liquor. In the exemplary embodiments delineated below the percentage of ingredient in the detergent is indicated except for copper, which for convenience is expressed as ppm $Cu^{++}$ in solution.

A plurality of washing solutions is prepared by dissolving 4 grams per liter of the above basic detergent composition in aqueous washing media. Washing is then carried out for 30 minutes at temperatures ranging from room temperature to 85° C and for 10 minutes at 85° C utilizing tap water having a calcium carbonate hardness of 250 ppm.

Bleaching efficiency is determined as follows:

Samples of cotton fabric are dyed by means of "Immedial Black" and inserted in the wash solution. Tergotometer tests are then made to determine bleaching efficiency, expressed as the reflectance increase through washing, $\Delta R_d$. In the testing process, copper is added as a solution directly to the washing solution to assure accurate dosage. A $\Delta R_d$ on "Immedial Black" of 8 is considered adequate to attain bleaching of natural stains.

The foregoing procedure was followed utilizing the schedule of additives set forth in the Table below:

TABLE OF BLEACHING EFFICIENCY

| Percentage by Weight | | $R_d$ for Cu++ ppm | | | | |
|---|---|---|---|---|---|---|
| STP | NTA | 0 | 1 | 2.5 | 5 | 10 |
| 45 | 0 | 9 | 8 | 7 | 4.5 | 1 |
| 30 | 10 | 3.5 | 6 | 7 | 9.5 | 13 |
| 20 | 15 | 3 | 5 | 6.5 | 8.5 | 10 |
| 15 | 19 | 2.5 | 5 | 6 | 8 | 10 |
| 0 | 30 | 3 | 4 | 6.5 | 7 | 9 |

Analysis of the "Table of Bleaching Efficiency" reveals that the addition of the nitrilotriacetic acid derivative to the detergent composition lowers the bleaching efficiency thereof, such being attributed to stabilization of the perborate. It is also observed that the addition of copper ions in the absence of NTA results in a destabilization of the perborate and a decrease in bleaching efficiency. However, in the presence of NTA, the addition of copper in the large quantities noted increases the bleaching efficiency. A more detailed analysis of the data resulting from the exemplary embodiments reveals that the desired level of bleaching efficiency, $\Delta R_d$ of 8, is attained when using from 3–10 ppm of $Cu^{++}$ in solution (750–2,500 p.p.m. or 0.075 – 0.25% on a detergent composition basis, with 4 grams of detergent composition per liter or per 1,000 grams of aqueous washing medium). As previously noted these ranges also correspond with a weight percentage of from about 0.1–1.0 percent based on the weight of copper salt in the detergent composition. In the above table it is seen that for compositions containing at least 10% of the organic builder and at least 15% of the inorganic builder, at wash water concentrations of 5 to 10 parts per million of copper, corresponding to 1,250 to 2,500 parts per million of copper in the detergent composition, improved bleaching efficiency is obtained and the level of bleaching efficiency is at or above the desired level.

EXAMPLE 2

Further experimentation was performed in the following manner.

A MIELE 421 automatic tumbler type washing machine having a high temperature cycle including a prewash and a main wash at 85°–90° C was employed. The detergent was employed in an amount of approximately 5 grams/liter utilizing the basic detergent noted above having additives as set forth in Table II.

Two matched paired loads of normally soiled laundry are prepared. One is washed with product "A" and one washed with product "B". Washing results are noted in terms of number of soiled spots remaining after wash and the difference $N_A$-$N_B$ between is recorded. The procedure is repeated twelve times with each machine and the average Δ for the 12 washes is tested for significance by the Student's *t* test. The results indicated a significant enhancement in the reduction of the number of soiled spots using product A.

Additionally test swatches are introduced with the wash loads and bleaching is measured on Immedial Black swatches as Δ $R_d$ similarly to the Tergotometer test.

| | Product Composition % | | | | | Results | | |
|---|---|---|---|---|---|---|---|---|
| | TPP | NTA | PERBORATE | HS | $CuSO_4 . 5H_2O$ | Bleaching | $R_d$ | Detergency |
| $A_1$ | 10 | 15 | 13.5 | 1 | 1 | 10 | | A significantly better than B |
| B | 42 | — | 22.5 | — | — | 5.5 | | |
| $A_2$ | 15 | 10 | 13.5 | 1 | 0.25 | 11 | | A significantly better than B |
| B | 42 | — | 22.5 | — | — | 5 | | |

Similar desirable cleaning effects are obtained to those observed in Examples 1 and 2 when the sodium salt of each of hydroxyethyl aminodiacetic acid, iminodiacetic acid and N,N-bis-(carboxymethyl)-amino-2-pentane dioic acid replace NTA.

It is understood that the invention is not limited to the specific embodiments described above. Various modifications can be made in the process and in the inventive preparations without departing from the spirit and scope of the invention.

What is claimed is:

1. A detergent composition consisting essentially of (a) 4 to 40% of a water soluble synthetic organic detergent selected from the group consisting of anionic, nonionic and amphoteric detergents; (b) 5 to 50% of a water soluble inorganic percompound selected from the group consisting of perborates, percarbonates and perphosphates; (c) 15 to 30% of alkali metal builder salt selected from the group consisting of alkali metal tripolyphosphates, alkali metal pyrophosphates, alkali metal orthophosphates and alkali metal citrates; (d) 10 to 19 of a water soluble salt of an acid selected from the group consisting of nitriloacetic acid, hydroxyethyl aminodiacetic acid, iminodiocetic acid and N,N-bis(-carboxymethyl)-amino-2-pentanedioic acid; and (e) such percentage of a water soluble inorganic copper salt as to contain, on a detergent composition basis, 0.125 to 0.25% of copper, with all percentages given being by weight.

2. A composition according to claim 1 wherein the water soluble salt of the acid is a water soluble salt of nitrilotriacetic acid.

3. A composition according to claim 1 wherein the water soluble synthetic organic detergent is a sodium salt of an alkyl benzene sulfonate having 8 to 18 carbon atoms in the alkyl group thereof.

4. A composition according to claim 1 wherein the inorganic copper salt is copper sulfate pentahydrate.

5. A composition according to claim 1 wherein the water soluble inorganic percompound is sodium perborate, the alkali metal builder salt is pentasodium tripolyphosphate and the water soluble salt of the acid is trisodium nitrilotriacetate.

6. A composition according to claim 2 wherein said inorganic percompound is sodium perborate, said builder salt is pentasodium tripolyphosphate, said copper salt is copper sulfate pentahydrate and said salt of nitrilotriacetic acid is sodium nitrilotriacetate.

7. A composition according to claim 3 wherein the alkyl aryl sulfonate is sodium dodecylbenzene sulfonate.

8. A composition according to claim 5 wherein the inorganic copper salt is copper sulfate pentahydrate.

9. A composition according to claim 6 which also contains from 0.5 to 2% of hydroxylamine sulfate, by weight.

* * * * *